US012577782B1

(12) United States Patent
Powers et al.

(10) Patent No.: US 12,577,782 B1
(45) Date of Patent: Mar. 17, 2026

(54) SAFETY CAGES FOR PROTECTING TUBULAR SKYLIGHTS

(71) Applicants: Michael Brent Powers, Cherry Hills Village, CO (US); Matthew Alexander Griffin, Castle Rock, CO (US); Wendy Jo Daisley, Thornton, CO (US); Eric Michael Scheel, Lakewood, CO (US)

(72) Inventors: Michael Brent Powers, Cherry Hills Village, CO (US); Matthew Alexander Griffin, Castle Rock, CO (US); Wendy Jo Daisley, Thornton, CO (US); Eric Michael Scheel, Lakewood, CO (US)

( * ) Notice: Subject to any disclaimer, the term of this patent is extended or adjusted under 35 U.S.C. 154(b) by 0 days.

(21) Appl. No.: 17/584,366

(22) Filed: Jan. 25, 2022

Related U.S. Application Data

(60) Provisional application No. 63/141,468, filed on Jan. 25, 2021.

(51) Int. Cl.
*E04D 13/03* (2006.01)

(52) U.S. Cl.
CPC ..... *E04D 13/0335* (2013.01)

(58) Field of Classification Search
CPC ..... E04D 13/03; E04D 13/0335; E04D 2013/034; E04D 2013/0345; F24S 11/007; E04B 9/32; F21V 15/02
USPC ..... 52/200
See application file for complete search history.

(56) References Cited

U.S. PATENT DOCUMENTS

| | | | | | |
|---|---|---|---|---|---|
| 419,186 | A * | 1/1890 | Culman, Jr. | F21V 15/02 | 362/380 |
| 459,749 | A * | 9/1891 | Hipwell | F21V 15/02 | 362/378 |
| 575,794 | A * | 1/1897 | Wagor | F21V 15/02 | 362/378 |
| 2,383,116 | A * | 8/1945 | Elg | F21V 15/02 | 431/111 |
| 2,515,451 | A * | 7/1950 | Isacoff | E04D 13/0335 | 160/88 |
| 2,858,734 | A | 11/1958 | Boyd | | |
| 3,826,912 | A * | 7/1974 | Pomroy | F21V 15/02 | 362/378 |

(Continued)

FOREIGN PATENT DOCUMENTS

| | | |
|---|---|---|
| CA | 2259419 C | 6/2004 |
| CA | 2261441 C | 1/2006 |

(Continued)

*Primary Examiner* — Kyle J. Walraed-Sullivan
(74) *Attorney, Agent, or Firm* — Red Rocks Law, LLC

(57) ABSTRACT

Disclosed herein are various examples of a cage device or apparatus for protecting an extension tube of a tubular skylight in a ceiling of a building. In one example, the cage device may include a plurality of lateral members surrounding the extension tube, the lateral members having a perimeter larger than the perimeter of the extension tube, the lateral members spaced apart along the extension tube; a plurality of vertically oriented elongated side members positioned around the perimeter of the extension tube, each side member attached to a portion of one of said lateral members, each side member having a top end portion that includes a protrusion for secure attachment to the roof or to the ceiling or the building; and a plurality of bottom members connected horizontally across one of said lateral members. Other embodiments are also disclosed.

20 Claims, 18 Drawing Sheets

(56) References Cited

U.S. PATENT DOCUMENTS 4,001,778 A * 1/1977 Ross ..... F21V 15/02 116/33
4,114,186 A 9/1978 Dominguez
4,114,330 A 9/1978 Sukolies
4,123,883 A 11/1978 Barber et al.
4,306,769 A 12/1981 Martinet
4,344,114 A * 8/1982 Denhart ..... F21S 8/04 362/147
4,462,392 A * 7/1984 Tipton ..... F21V 13/04 359/627
4,570,396 A 2/1986 Struben
4,660,463 A 4/1987 Bottomore et al.
5,010,700 A 4/1991 Blair
5,027,566 A 7/1991 Gilowski
5,099,622 A 3/1992 Sutton
5,175,967 A 1/1993 Greenwood
5,419,090 A * 5/1995 Sandow ..... E04D 3/32 52/200
5,544,455 A 8/1996 DeBlock
5,572,819 A * 11/1996 Topinka ..... G09F 13/04 362/812
5,596,848 A 1/1997 Lynch
5,647,915 A 7/1997 Zukerman
5,655,339 A * 8/1997 DeBlock ..... E04D 13/03 52/200
5,896,712 A 4/1999 Chao
5,896,713 A 4/1999 Chao et al.
5,983,581 A 11/1999 DeBlock et al.
6,219,977 B1 4/2001 Chao et al.
6,256,947 B1 7/2001 Grubb
6,385,922 B1 5/2002 Mors
6,604,332 B1 * 8/2003 Hughes ..... E04D 13/033 52/200
6,990,773 B2 1/2006 Borges
7,757,444 B1 7/2010 Halliday
8,018,653 B2 9/2011 Jaster
8,079,738 B1 * 12/2011 Schlappi ..... F21V 17/107 362/363
8,209,923 B1 7/2012 Rich
8,272,175 B1 * 9/2012 Williams-Prades ..... E04H 1/14 135/900
8,371,078 B2 2/2013 Jaster
8,534,008 B1 9/2013 Konstantin
8,568,011 B2 10/2013 Rillie et al.
8,793,944 B2 8/2014 Blomberg et al.
8,797,652 B2 8/2014 Mosher
8,837,048 B2 9/2014 Jaster
8,958,157 B2 2/2015 Rillie et al.
8,982,467 B2 3/2015 Jaster
9,291,321 B2 3/2016 Jaster
9,322,178 B2 4/2016 Kastner et al.
9,482,399 B2 11/2016 Rimsky et al.
D794,216 S 8/2017 Kastner
9,752,743 B1 9/2017 Greinke
9,816,675 B2 11/2017 Jaster
9,816,676 B2 11/2017 Jaster
D804,638 S * 12/2017 Guthrie ..... D23/385
9,921,397 B2 3/2018 Jaster
D834,172 S * 11/2018 Guthrie ..... D26/59
D856,572 S * 8/2019 Haggar ..... D26/119
D941,516 S * 1/2022 Holmes ..... D26/59
D942,669 S * 2/2022 Li ..... D26/89
D979,114 S * 2/2023 McRoberts ..... D26/59
2001/0013207 A1 8/2001 O'Neill
2002/0051297 A1 5/2002 Hoy et al.
2003/0035292 A1 * 2/2003 Thome ..... F21V 15/02 362/147
2003/0066254 A1 4/2003 DeBlock
2003/0079422 A1 5/2003 Bracale
2004/0000107 A1 1/2004 Landis
2005/0039410 A1 2/2005 Hoy et al.
2006/0191214 A1 8/2006 Rillie
2007/0217208 A1 * 9/2007 Yurich ..... F21V 15/02 362/186
2010/0309556 A1 12/2010 Jaster
2011/0017967 A1 * 1/2011 Whiting ..... E06C 7/006 256/59
2011/0044041 A1 2/2011 Jaster
2011/0141570 A1 6/2011 Rillie et al.
2012/0195041 A1 * 8/2012 Fletcher ..... F21V 15/02 362/249.02
2015/0167305 A1 * 6/2015 Kastner ..... E04B 7/18 52/200
2018/0202164 A1 7/2018 Pendley et al.
2018/0334814 A1 * 11/2018 Rashid ..... E04D 13/12
2020/0149282 A1 * 5/2020 Rivest ..... E04D 13/031

FOREIGN PATENT DOCUMENTS

EP 3315684 A1 5/2018
WO WO2014018154 A1 1/2014

* cited by examiner

SAFETY CAGES FOR PROTECTING TUBULAR SKYLIGHTS

CROSS-REFERENCE TO RELATED APPLICATION

This application claims the benefit of and priority to, under 35 U.S.C. 119(e), U.S. Provisional Patent Application No. 63/141,468 filed Jan. 25, 2021 entitled "SAFETY CAGES FOR PROTECTING TUBULAR SKYLIGHTS" the disclosure of which is hereby incorporated by reference in its entirety.

TECHNICAL FIELD

The present disclosure relates generally to tubular skylights.

BACKGROUND

Tubular skylights are used in ceilings of various buildings, such as gymnasiums, commercial buildings, facilities and other buildings, to direct light (i.e., daylight/sunlight) into the building through the skylight. For example, tubular skylights typically extend downwardly from a ceiling, and include parts such as extension tubing, diffuser lenses, and electrical components.

The present inventors have recognized that tubular skylights, once installed, can by damaged, for instance, when hit by a ball or other projectile.

SUMMARY

As recognized by the present inventors, what is needed is a cage device or apparatus to provide protection of tubular skylights.

According to one broad aspect of one embodiment of the present disclosure, disclosed herein is a safety cage device for protecting an extension tube of a tubular skylight in a ceiling of a building. In one embodiment, the cage device may include a plurality of lateral members, a plurality of vertically orientated side members, and a bottom end cap.

In one example, the lateral members surround the extension tube of the tubular skylight and have a perimeter larger than the perimeter of the extension tube of the tubular skylight. The lateral members may be spaced apart along the body portion of the tubular skylight. In one embodiment, the lateral members may be formed using metal rods formed in a circular shape or other shape. If desired, the lateral members may be spaced apart equally along the extension tube.

In one example, the side members are elongated and may be positioned around the perimeter of the extension tube of the tubular skylight. Each side member may be attached to a portion of one of said lateral members, and each side member may have a top end portion that includes a protrusion for secure attachment to the roof or to the ceiling.

In one embodiment, the bottom end cap may be formed using a plurality of bottom members connected horizontally across one of said lateral members. The bottom end cap may be selectively removable in order to provide access to the extension tube portion of the tubular skylight, for instance for servicing, repair or other purpose.

In this manner, one embodiment of a cage device can be formed which surrounds the extension tube of the tubular skylight, and thereby provides structural protection to the tubular skylight while still allowing light to pass through the cage device.

In one example, each of the side members may be formed using metal rods, and each side member is attached to one of said lateral members using a welded connection. In one example, each of the side members may have a length longer than the length of the extension tube that extends downwardly from the ceiling, and the side members may be spaced equally apart around the perimeter of the extension tube of the skylight. In one embodiment, the plurality of side members may be formed from a set of four side members, spaced apart in 90-degree intervals from each adjacent side member. Each protrusion of each side member may be securely connected to the roof or to the ceiling of the building.

In another embodiment, the cage device may include a mesh screen positioned within the lateral members. The cage device may also include a safety tether cable or harness connected at one end to one of said lateral members, and the other end of the safety cable secured to the ceiling.

Embodiments of the present disclosure can be used with buildings that have an open ceiling configuration, or with buildings that have a traditional ceiling configuration.

According to another broad aspect of another embodiment of the present disclosure, disclosed herein is a cage device for protecting a tubular skylight in a ceiling of a building, the tubular skylight having an extension tube with a perimeter and a length extending downwardly from the ceiling. In one embodiment, the cage device may include a plurality of lateral members surrounding a portion of the extension tube of the tubular skylight, the lateral members having a perimeter larger than the perimeter of the extension tube, the lateral members spaced apart along the extension tube; a plurality of vertically oriented elongated side members positioned around the perimeter of the extension tube of the tubular skylight, each side member attached to a portion of one of said lateral members, each side member having a top end portion that includes a protrusion for secure attachment to the roof or to the ceiling, each side member having a bottom end portion; and a removable end cap connected to the bottom end portions of the side members.

In one example, each protrusion of each side member may be securely connected to the roof or to the ceiling. The side members may be spaced equally apart around the perimeter of the extension tube of the tubular skylight. Each of the side members may be formed from using metal rods; and the lateral members can also be formed using metal rods formed in a circular shape or other shape as shown herein; wherein each side member is attached to one of said lateral members using a welded connection. Or, in another embodiment, the lateral members and side members are integrally formed using a mold.

In another embodiment, the cage device may also include a mesh screen positioned within the lateral members. The cage device may also include a safety cable, tether or harness connected to one of said lateral members and secured to a ceiling.

Other embodiments of the disclosure are described herein. The features, utilities and advantages of various embodiments of this disclosure will be apparent from the following more particular description of embodiments as illustrated in the accompanying drawings.

DETAILED DESCRIPTION

Figure 1:
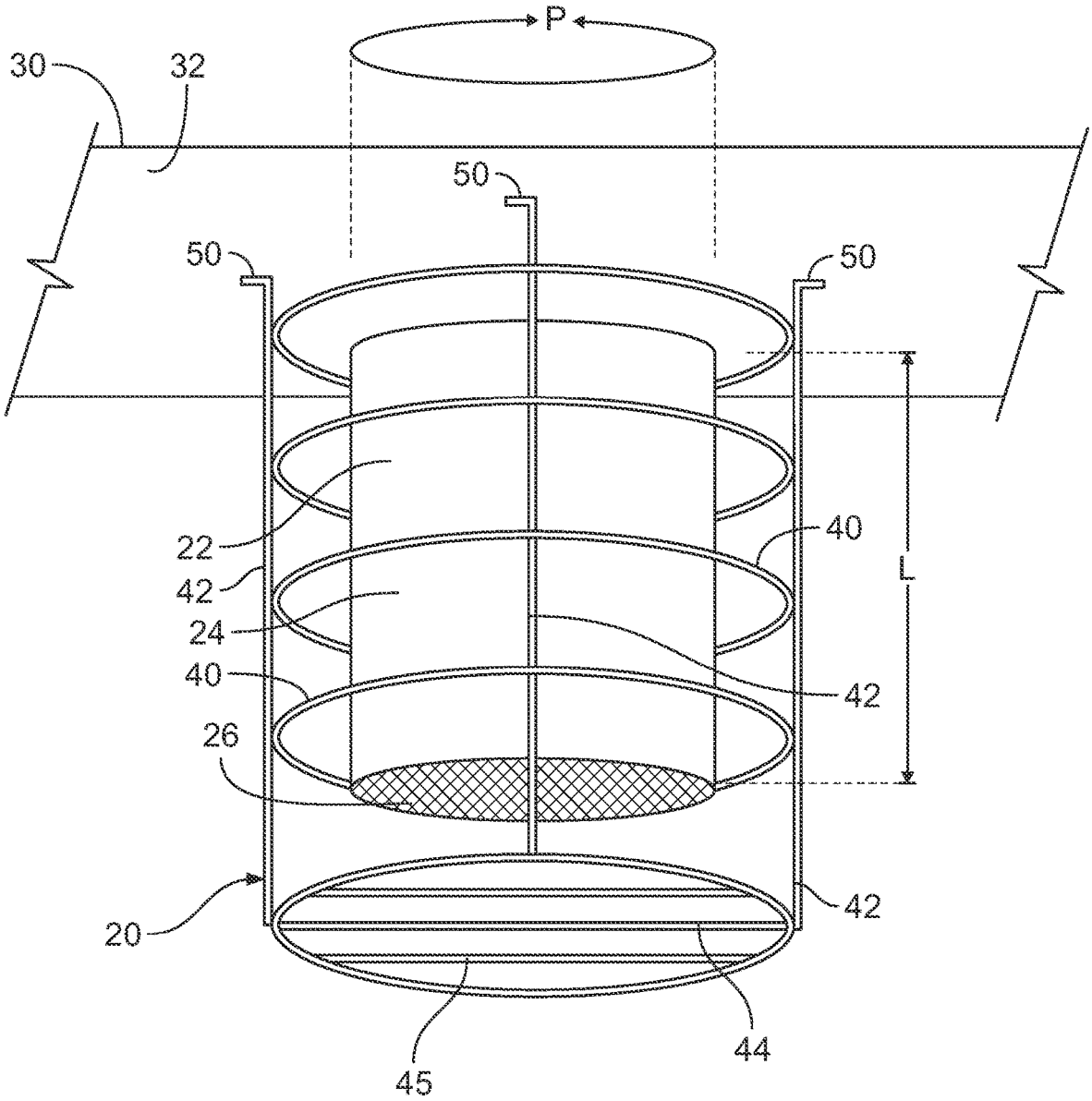
FIG. 1 illustrates an example of a cage device for a tubular skylight, in accordance with one embodiment of the present disclosure.
Figure 2:
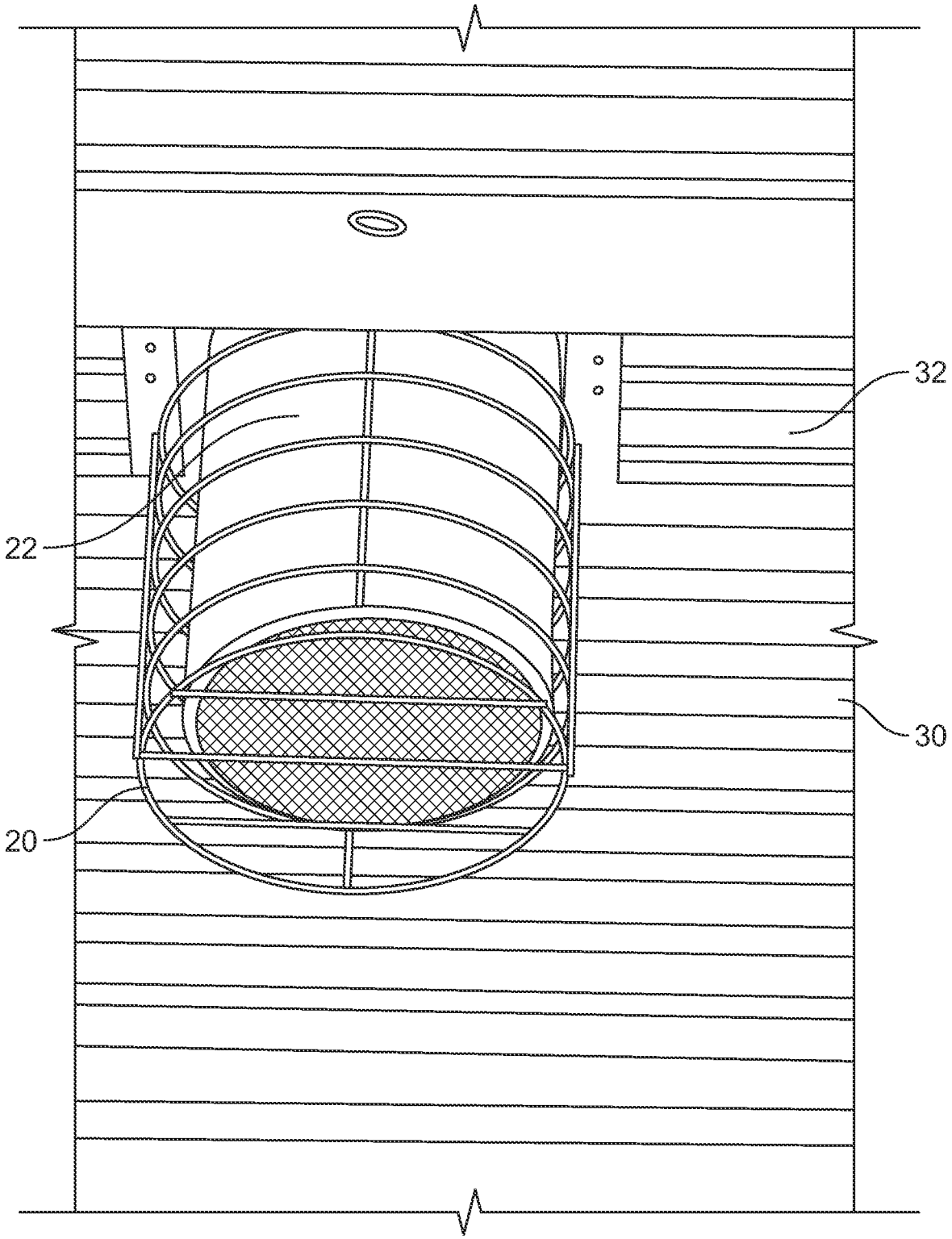
FIG. 2 illustrates an example of a cage device for a tubular skylight, in accordance with one embodiment of the present disclosure.

Disclosed herein are various embodiments of cages or other structures, apparatus or devices 20 for protecting tubular skylights 22 and their related components of extension tubes 24, diffuser lenses 26 and electrical components. In addition, by protecting the skylights 22, the cage devices 20 disclosed herein can also help protect students, faculty, and other persons in a gymnasium or other buildings that have tubular skylights. The cage devices 20 can also help reduce the risk of animals or people entering (or escaping) a building 30 through the ceiling 32 or roof 34 through the skylights 22. Because of the structures of the cage devices 20 disclosed herein, the cage devices 20 do not significantly reduce or impair the amount of daylight transmitted by a tubular skylight 22 into the building 30. The cage devices 20 of the present disclosure can be used with buildings 30 that have an open ceiling configuration, or with buildings 30 that have traditional closed ceiling configurations. Various examples of embodiments of the present disclosure are described herein.

The following detailed description refers to the accompanying drawings that depict various details of examples selected to show how particular embodiments may be implemented. The discussion herein addresses various examples of the inventive subject matter at least partially in reference to these drawings and describes the depicted embodiments in sufficient detail to enable those skilled in the art to practice the embodiments. Many other embodiments may be utilized for practicing the subject matter other than the illustrative examples discussed herein, and many structural and operational changes in addition to the alternatives specifically discussed herein may be made without departing from the scope of the disclosed subject matter.

In this description, references to "one embodiment" or "an embodiment," or to "one example" or "an example" mean that the feature being referred to is, or may be, included in at least one embodiment or example of the disclosure. Separate references to "an embodiment" or "one embodiment" or to "one example" or "an example" in this description are not intended to necessarily refer to the same embodiment or example; however, neither are such embodiments mutually exclusive, unless so stated or as will be readily apparent to those of ordinary skill in the art having the benefit of this disclosure. Thus, the present disclosure includes a variety of combinations and/or integrations of the embodiments and examples described herein, as well as further embodiments and examples as defined within the scope of all claims based on this disclosure, as well as all legal equivalents of such claims.

Referring to FIGS. 1-12, various embodiments of cage devices 20 are shown for protecting an extension tube 24 of a tubular skylight 22 in a building 30. The cage devices 20 may be formed using straight or shaped rods, bars, wires or other rigid members that in one example are attached to a ceiling surface 32 or roof structure 34 of a building 30, and surround the exterior of the extension tube 24 of a tubular skylight 22 extending into the building 30. The cage device 20, once installed about and around portions of the skylight 22 such as the extension tube 24 of the tubular skylight 22, provide structural protection to the extension tube 24 of the tubular skylight 22, as the cage device 20 is adapted to absorb any force or impact from a ball, projectile or other object that would otherwise impact and damage the extension tube 24 of the tubular skylight 22. As used herein, the terms cage device, safety cage, cage apparatus, cage structure, and any combinations thereof, are interchangeably referred to as a cage device 20, understanding that various embodiments of cage devices 20 can be formed utilizing one or more features, structures or aspects as disclosed herein.

In one example, a cage device 20 may generally define a structure, framework or enclosure that surrounds and can be used to protect a portion of a downwardly extending tubular skylight 22, such as the extension tube 24 and diffuser lens 26. As shown in the FIG. 1, an extension tube 24 has a perimeter (P) and a length (L) extending downwardly from the ceiling 32.

As shown in the example of FIG. 1, a cage device 20 may include one or more lateral members 40, a plurality of side members 42, and a base/bottom end cap 44. In some embodiments, these components can be connected together (such as through metal welded connections), or integrally molded, to form a cage device 20 that protects an extension tube 24 of a tubular skylight 22.

The lateral members 40 are positioned to surround a portion of the extension tube 24 of the tubular skylight 22. The lateral members 40 may be formed using metal rods, bars, wires, or other rigid members that are formed in a circular, oval or round shape or other shapes as described herein.

In one example, the lateral members 40 have a perimeter larger than the perimeter (P) of the extension tube 24, and the lateral members 40 are spaced apart along a portion of the extension tube 24. The lateral members 40 may be spaced apart equally along a portion of the extension tube 24, or they may be staggered or positioned using other spacing.

In one example, the lateral members 40 and base/bottom members 44 may include but are not limited to circular members (FIGS. 1-8A); the lateral members 40 and base/bottom members 44 may be formed using other shapes or curves, such as square or rectangular (FIG. 8B), multi-sided such as pentagon or hexagon (FIG. 8C), triangular (FIG. 8D), or other shapes.

The cage device 20 may also include a plurality of vertically oriented elongated side members 42, such as but not limited to rods, bars, wires, or rigid members. The vertical side members 42 may be attached to a portion of the lateral members 40, such as through metal welds, or using any other conventional means of attachment including adhesives, nuts/bolts, ties, tongue/groove, or interlocking or mating structures.

In one example, each of the side members 42 has a length longer than the length (L) of the extension tube 24 extending downwardly from the ceiling 32.

In one example, each side member 42 has a top end portion 46 that includes a protrusion or extension 50 which creates or defines an engagement surface for secure attachment to the building's roof 34, ceiling 32, or both. As mentioned herein, the ceiling 32 may be an open ceiling, or a traditional closed ceiling. Each side member 42 may also have a bottom end portion 47 for connection to a base or bottom end cap 44.

In one embodiment, the side members 42 are spaced equally apart around the perimeter of the extension tube 24. For instance, and in one example, the plurality of side members 42 may be formed from a set of four side members 42, spaced apart in 90-degree intervals from each adjacent side member 42.

As shown in FIGS. 1, 3-6, 8A-E, and 9-12, each of the protrusions 50 on the upper ends 46 of the side members 42 can be used to secure each of the respective vertical side members 42 to a surface or structure such as ceiling 32 or a roof 34 adjacent to the skylight 22. In this manner, the cage device 20 can be secured to the ceiling 32 and supported by the ceiling 32, or secured to the roof 34 and supported by the roof 34, or both. The cage device can be attached to the interior of the ceiling 32 (i.e., FIG. 1), or if desired to the roof 34 or roof deck (i.e., FIGS. 2, 5, 7, 9A-9B, 10). Attachment may be realized via mechanical connection to ceiling surfaces/steel angles/protrusions supporting the tubular skylight opening (interior installation) such as shown in FIG. 1; or to the skylight curb 51 (for rooftop 34 installation), such as shown in FIGS. 9B, 10 and 12.

As shown in FIGS. 5, 9A-9B, 10 and 12, a plurality of brackets 52, bolts and/or screws 54 can be used to securely connect each side member 42 to the ceiling 32 or to the roof 34, for instance using two or more bolts 54 and one of said brackets 52. If desired, other securement mechanisms or structures can be used.

On the bottom portion of the cage device 20, a base or bottom end cap 44 is provided. In one example, the bottom end cap 44 is formed as a set of bottom members 45 such as but not limited to linear lateral rods connected with and across the lowest lateral member 40, and if desired may also be connected with one or more of the vertical side members 42.

In one embodiment and as shown in FIGS. 7, 8A-E and 10-12, the base/bottom end cap 44 may be selectively removable, or may be opened or closed (e.g., using a hinge on one end of the base), in order to provide access to the skylight 22, for instance for servicing, cleaning, repairing or accessing the skylight 22, the extension tube 24, the diffuser 26, electronic components (e.g., dimmer), or other items. For instance, interlocking pairs of tabs and slots 56 (FIGS. 8A-8B, 10-12) or other interlocking mechanisms can be provided on the upper portion of the base/bottom end cap 44 and the bottom portion of the cage device 20, to thereby selectively and releasably couple the base/bottom end cap to the lower portion of the cage device. In another example, fasteners such as Dzus fasteners (e.g., winged or slotted) can be used to selectively and releasably couple the base/bottom end cap 44 to the lower portion of the cage device 20. In another embodiment, the base/bottom end cap 44 can be permanently fixed (i.e., using a welded connection) to provide enhanced security (e.g., FIG. 1).

In this manner, once installed, the cage device 20 will absorb forces (and transfer such forces to the ceiling 32/roof 34) from projectiles such as basketballs, volleyballs, tennis balls, baseballs, footballs, soccer balls, or other similar projectile, thereby protecting the skylight extension tube 24 positioned within the cage device 20.

As mentioned herein, the lateral members 40, side members 42, and the bottom base member 44 can be formed using rods, bars, wires, or rigid members, integrated materials, or any combination thereof. For instance, a cage device 20 may be formed using steel or aluminum rods, such as ¼" to ½" in diameter, with welded connections around the perimeter. The rods may have painted, powder coated or anodized finishes. Mechanical fasteners and clips can match the finish of cage device material. If desired, sheet metal, plastic, or acrylic sheets can be added on the inside of a cage device and can be finished as desired for branding or aesthetic purposes.

In another example, a cage device 20 may be formed using a mold to form an integrated and/or unitary structure having one or more structure features as described herein. For instance, a mold could be used to repeatably mass produce cage devices 20 using molten or liquid metal, aluminum, plastic, rubber or other materials poured into the mold so that when the material hardens, a rigid cage device 20 is formed.

In another example, 3D printers can be used to form cage devices 20 including one or more structural features as described herein.

Figure 3:
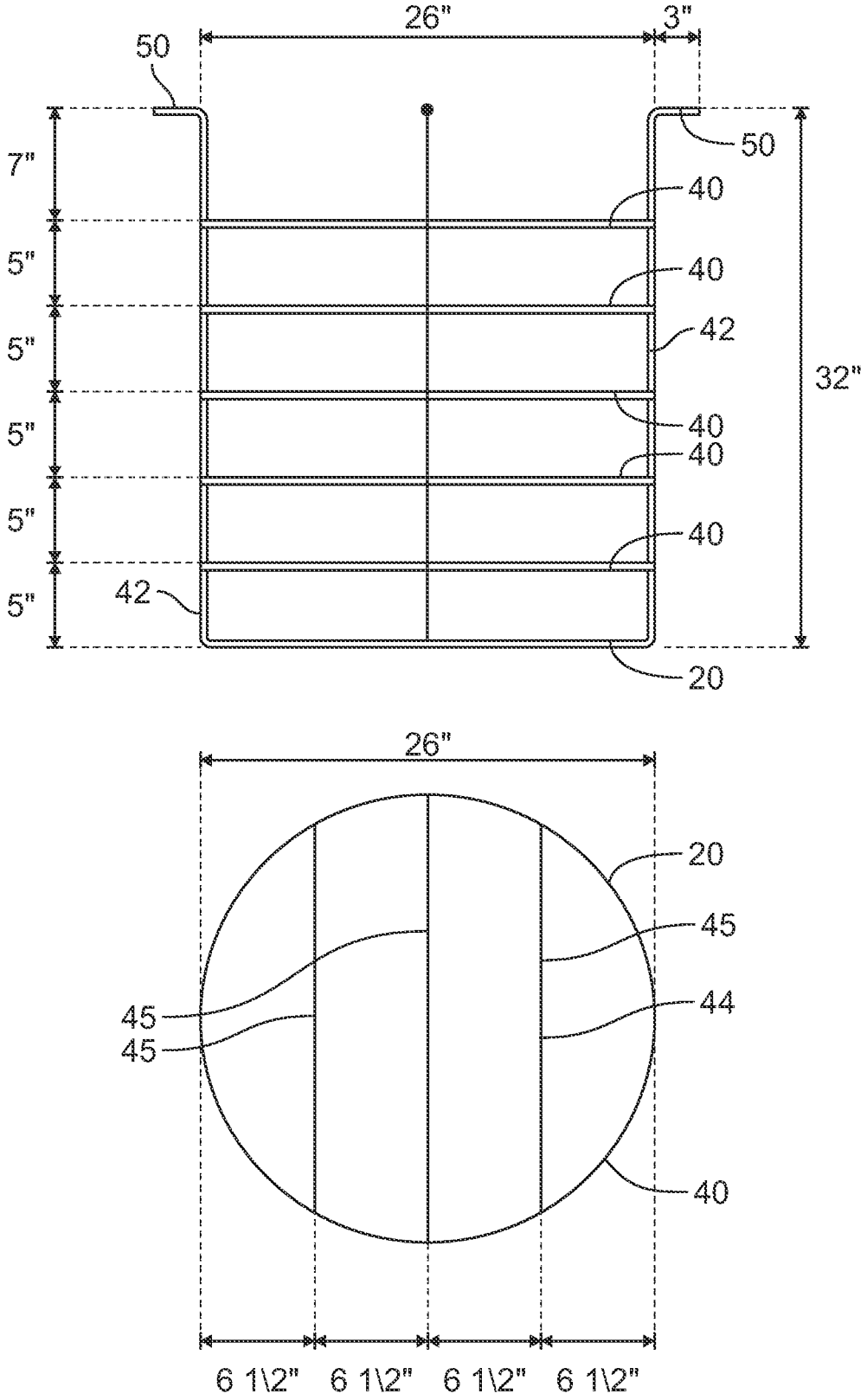
FIG. 3 illustrates examples of dimensions that may be used to form one embodiment of a cage device for a tubular skylight, in accordance with one embodiment of the present disclosure.
Figure 4:
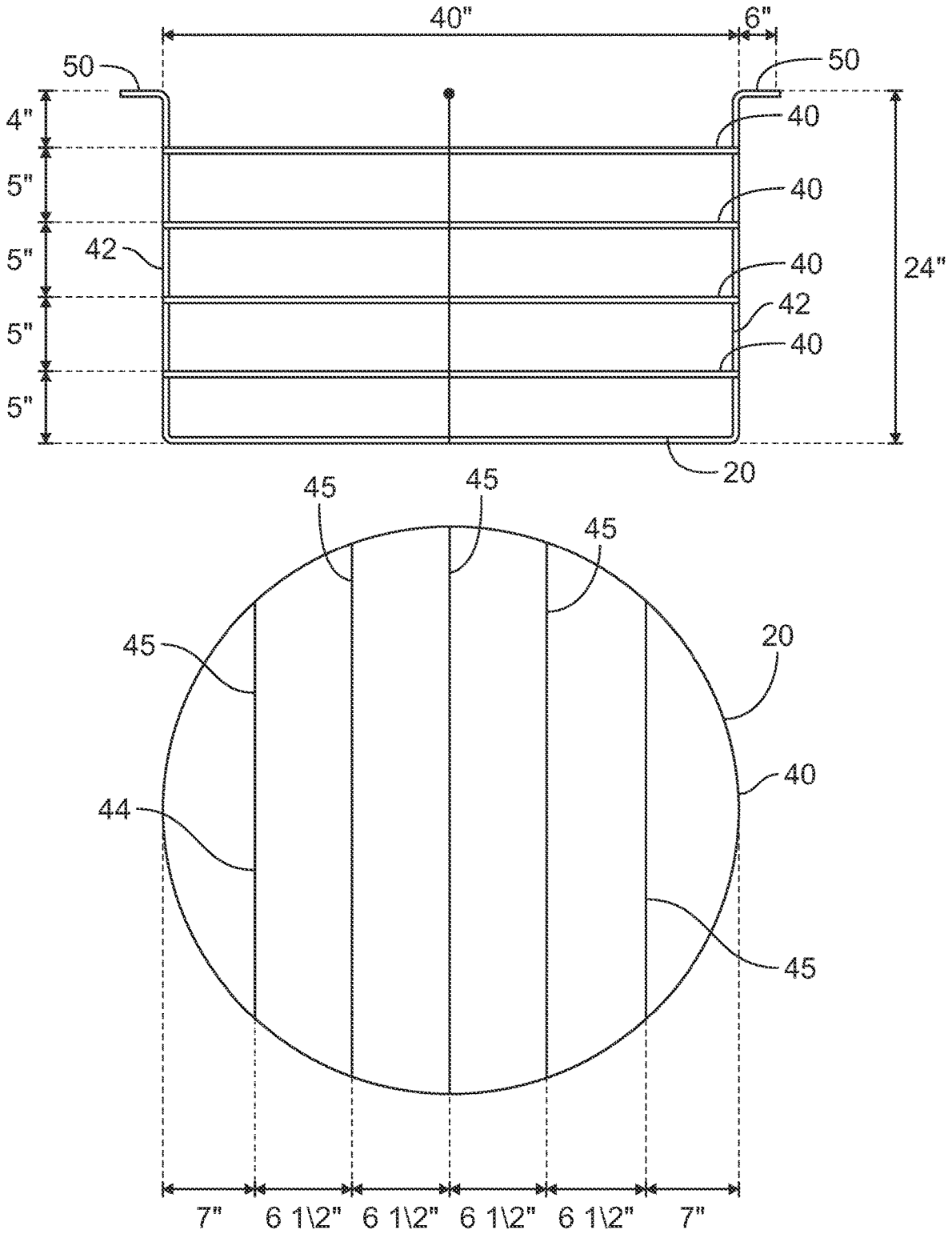
FIG. 4 illustrates another set of example dimensions that may be used to form one embodiment of a cage device for a tubular skylight, in accordance with one embodiment of the present disclosure.
Figure 5:
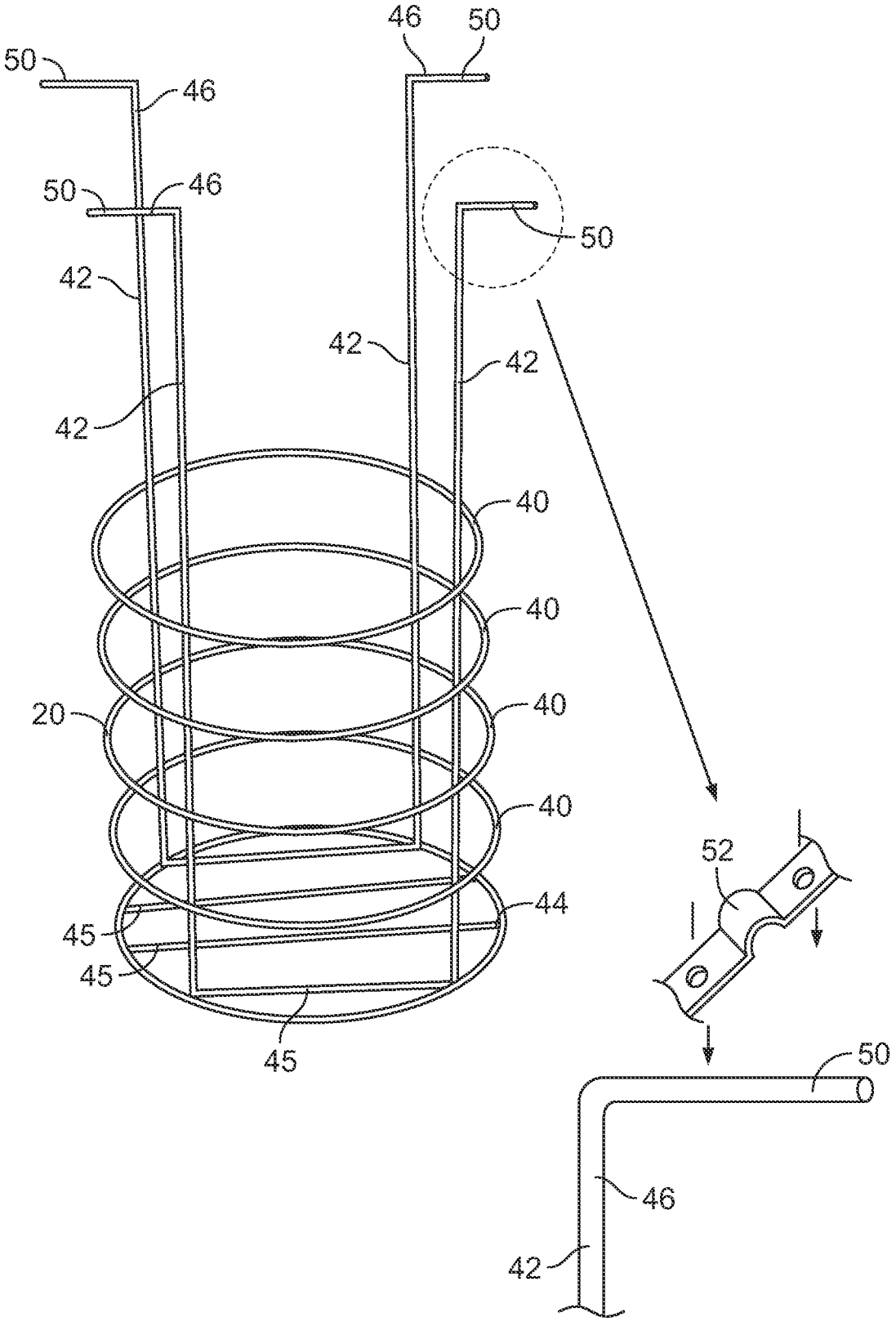
FIG. 5 illustrates another example of a cage device for a tubular skylight, with an attachment bracket that may be used to secure the cage device to a structure or surface such as a roof or ceiling, in accordance with one embodiment of the present disclosure.

Examples of possible dimensions for various examples of cage devices 20 are provided in FIGS. 3-4, in accordance with various embodiments of the present disclosure. These dimensions can be used to form cage devices 20 that can be made to be placed around conventionally-sized tubular skylights 22 which typically have bottom diameters between 10 inches to 29 inches or more, and bottom light amplifiers 60 (FIGS. 9A-9C) can increase this size to approximately 35 inches or more.

The perimeters or circumferences of various cage devices 20 can be designed or modified to fit around any/all tubular skylight 22 sizes. The length of a cage device 20 can be designed or modified to fit any drop length (L) of the extension tube 24 from the roof deck. Sway bracing or other attachment mechanisms 62 (FIG. 10) (i.e., brackets and bolts/screws) may be used to attach and secure the cage device 20 to a roof deck 34 or a ceiling 32 if desired.

Moreover, spacing of lateral members 40, side members 42, and base/bottom members 44 can be formed to protect the tubular skylight 22 components from objects of various sizes, such as larger volleyballs and basketballs to smaller tennis balls, baseballs, hockey pucks.

Figure 7:
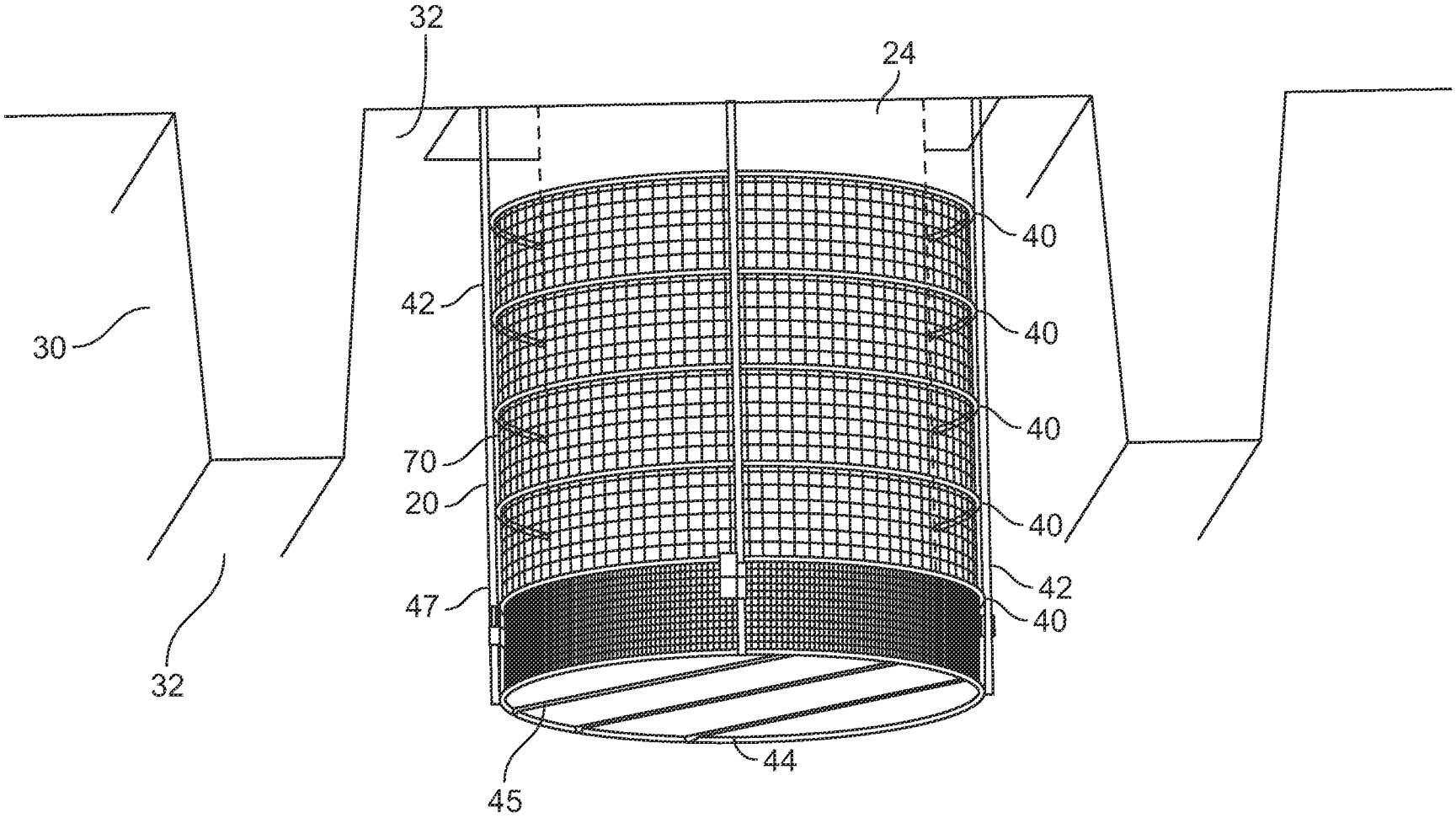
FIG. 7 illustrates another example of a cage device for a tubular skylight, with a mesh screen and with a removable bottom end cap, in accordance with one embodiment of the present disclosure.
Figure 8A:
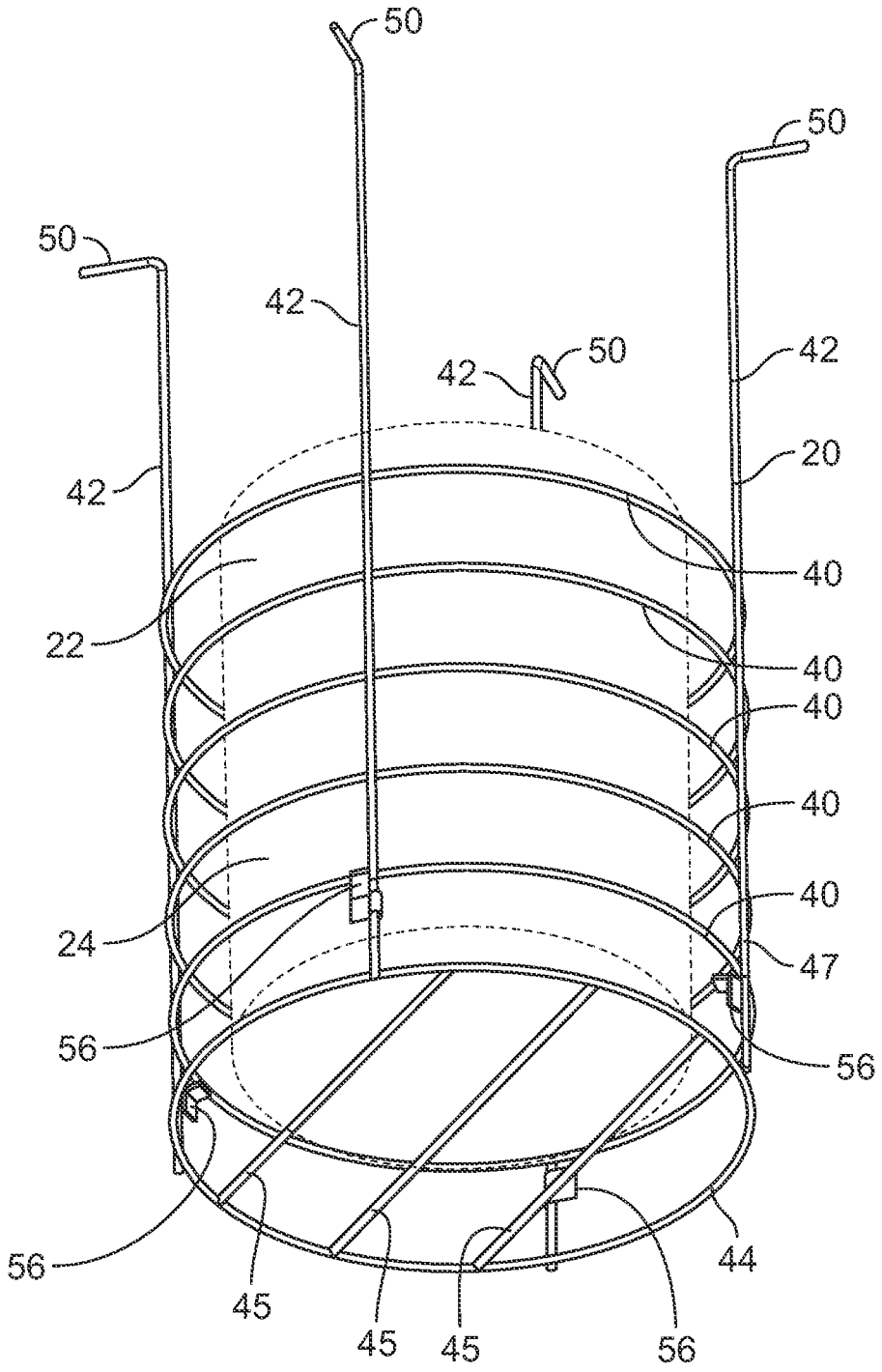
FIGS. 8A and 8E illustrate another example of a cage device for a tubular skylight, with a removable bottom end cap, in accordance with one embodiment of the present disclosure.
Figure 8B:
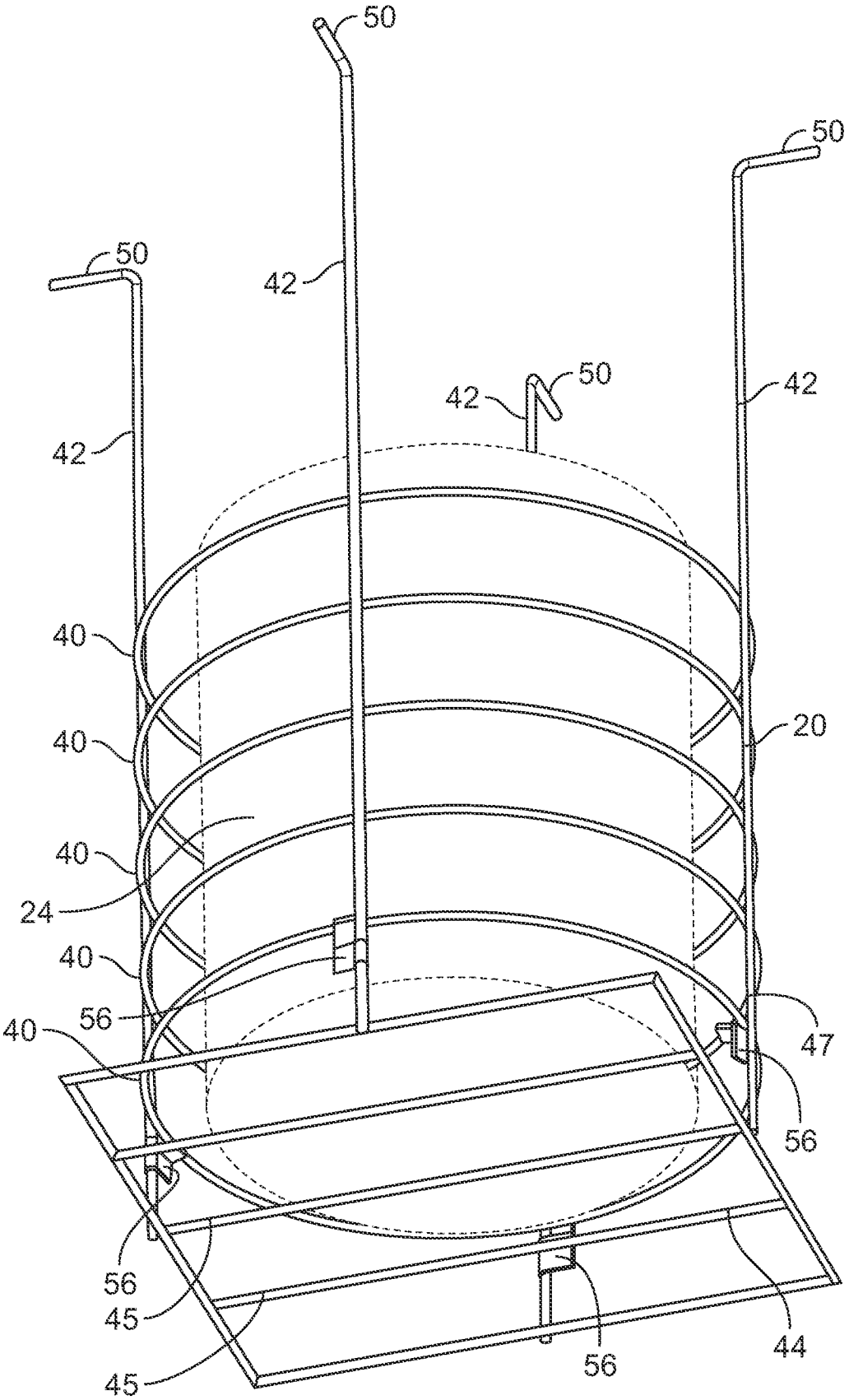
FIGS. 8B-8D illustrate various examples of a cage device for a tubular skylight, with removable bottom end caps having differing shapes or designs, in accordance with one embodiment of the present disclosure.
Figure 8C:
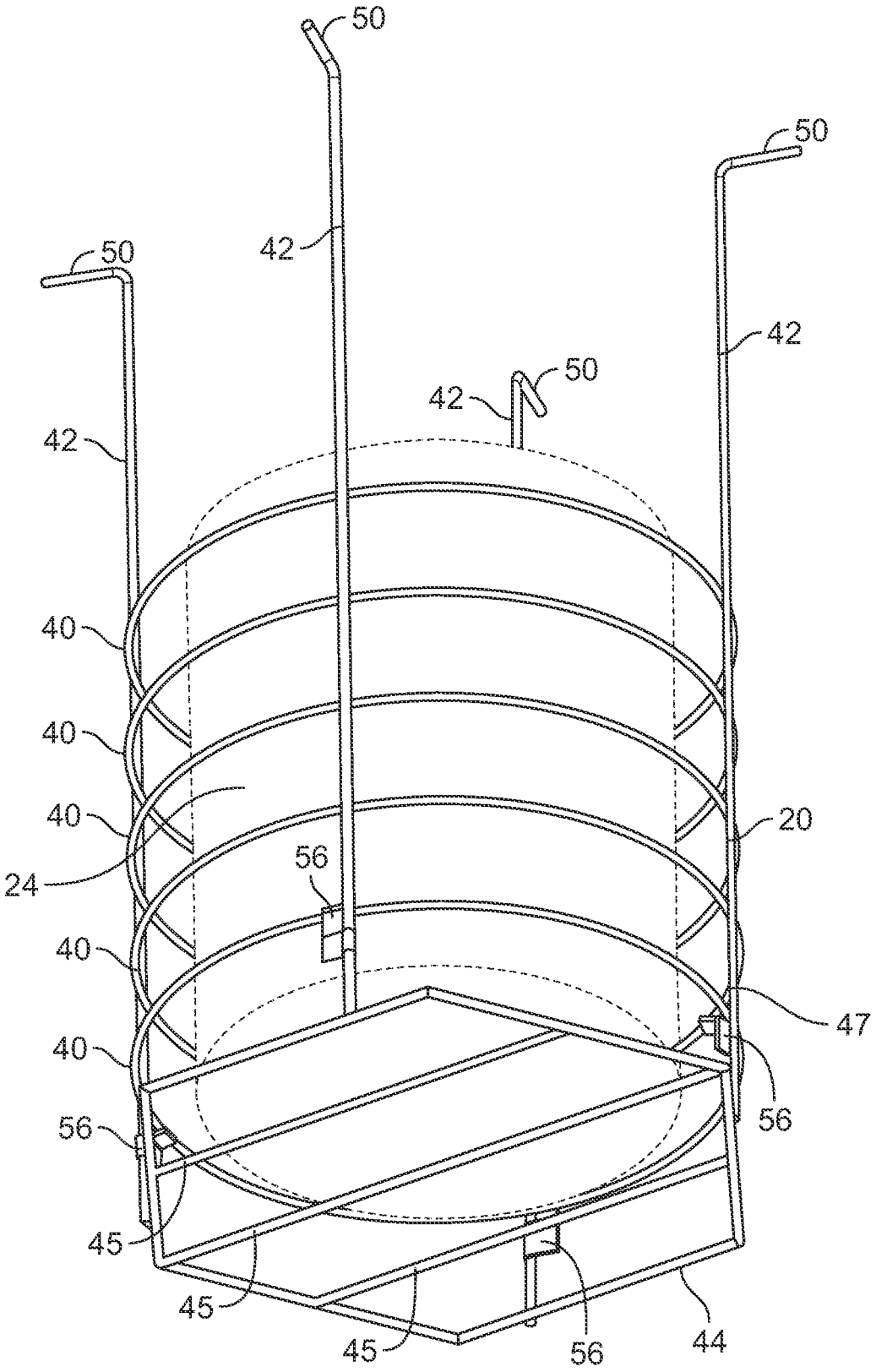
Figure 8D:
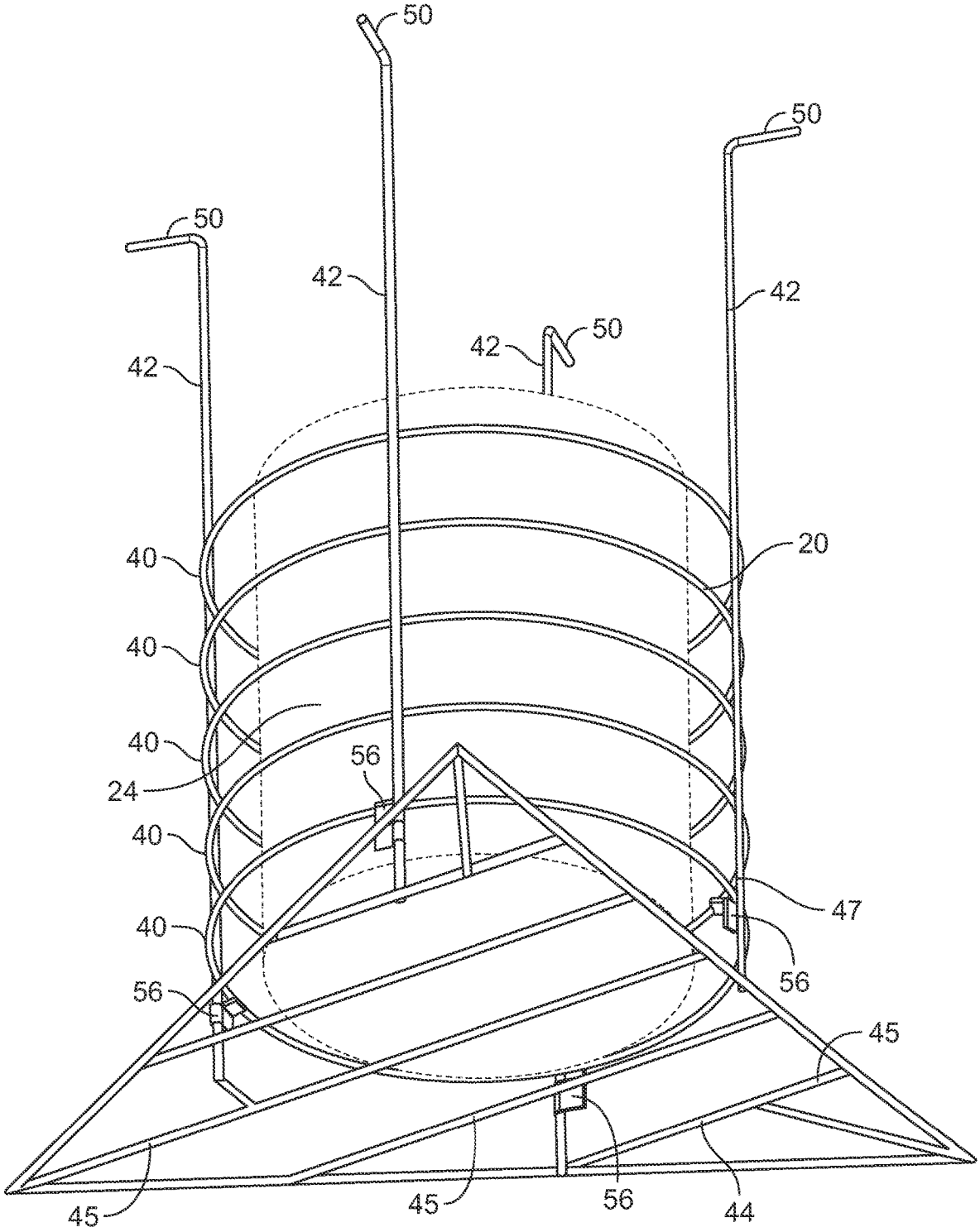
Figure 8E:
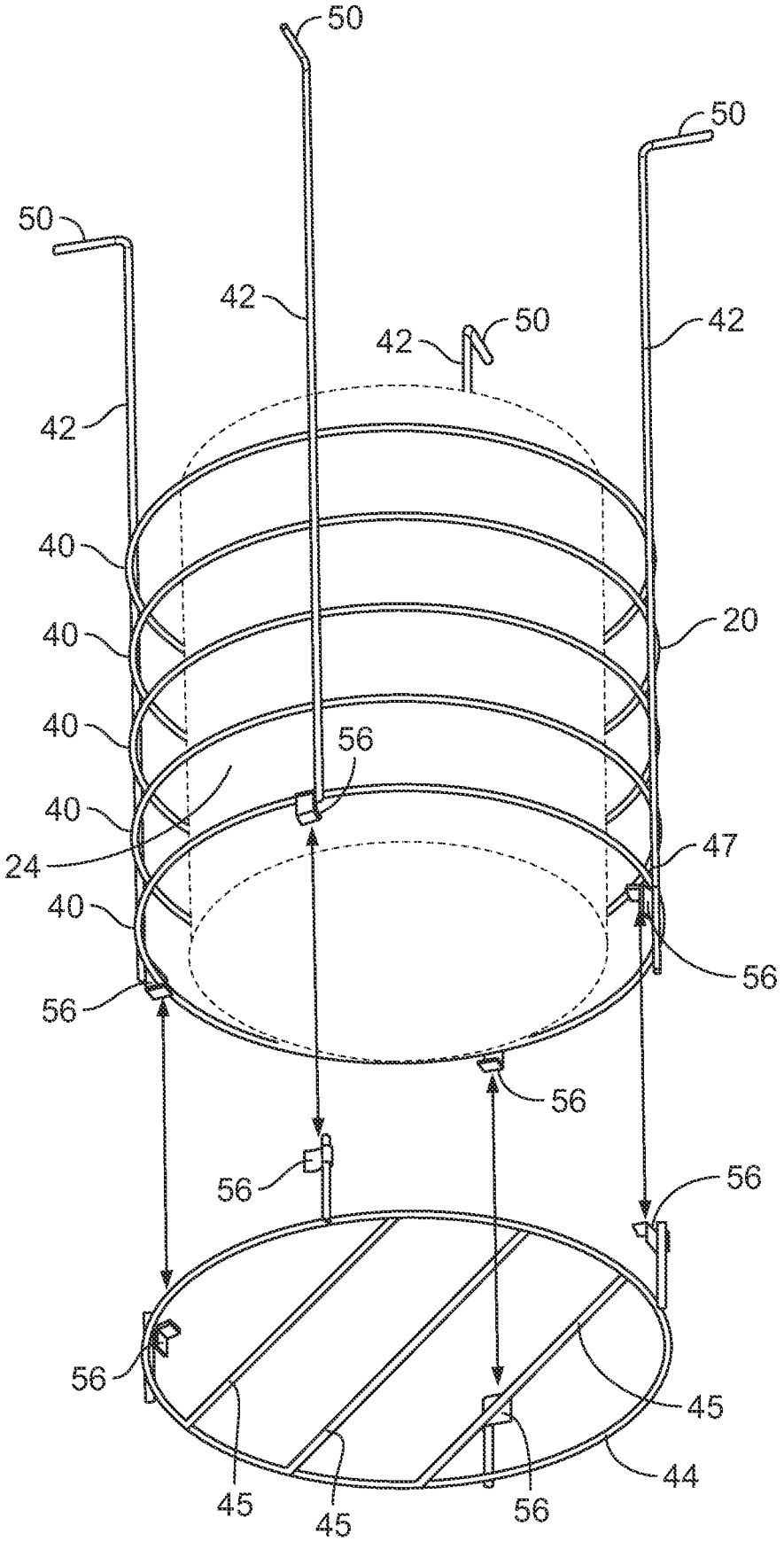

If desired and as shown in the example of FIGS. 7 and 12, mesh screens 70 (FIGS. 7, 12) (i.e., made of steel or other material) or sheet metal could be added on the inside of a cage device 20 to provide additional protection where desired. For instance, a mesh screen 70 can be positioned within and secured to the lateral members 40 of a cage device 20.

In another example, supplemental bracing, struts, or support arms can be added and attached from the bottom of the cage device 20 to the ceiling structure 32 above the cage device 20, if additional reinforcement is desired based on anticipated possible forces and/or significant drop length (L) of the extension tube 24. If desired and in one example, attachments mechanisms used for attaching or stabilizing a cage device 20 to the ceiling 32 or a roof 34 can be provided to accommodate seismic engineering parameters or other extreme conditions.

Figure 6:
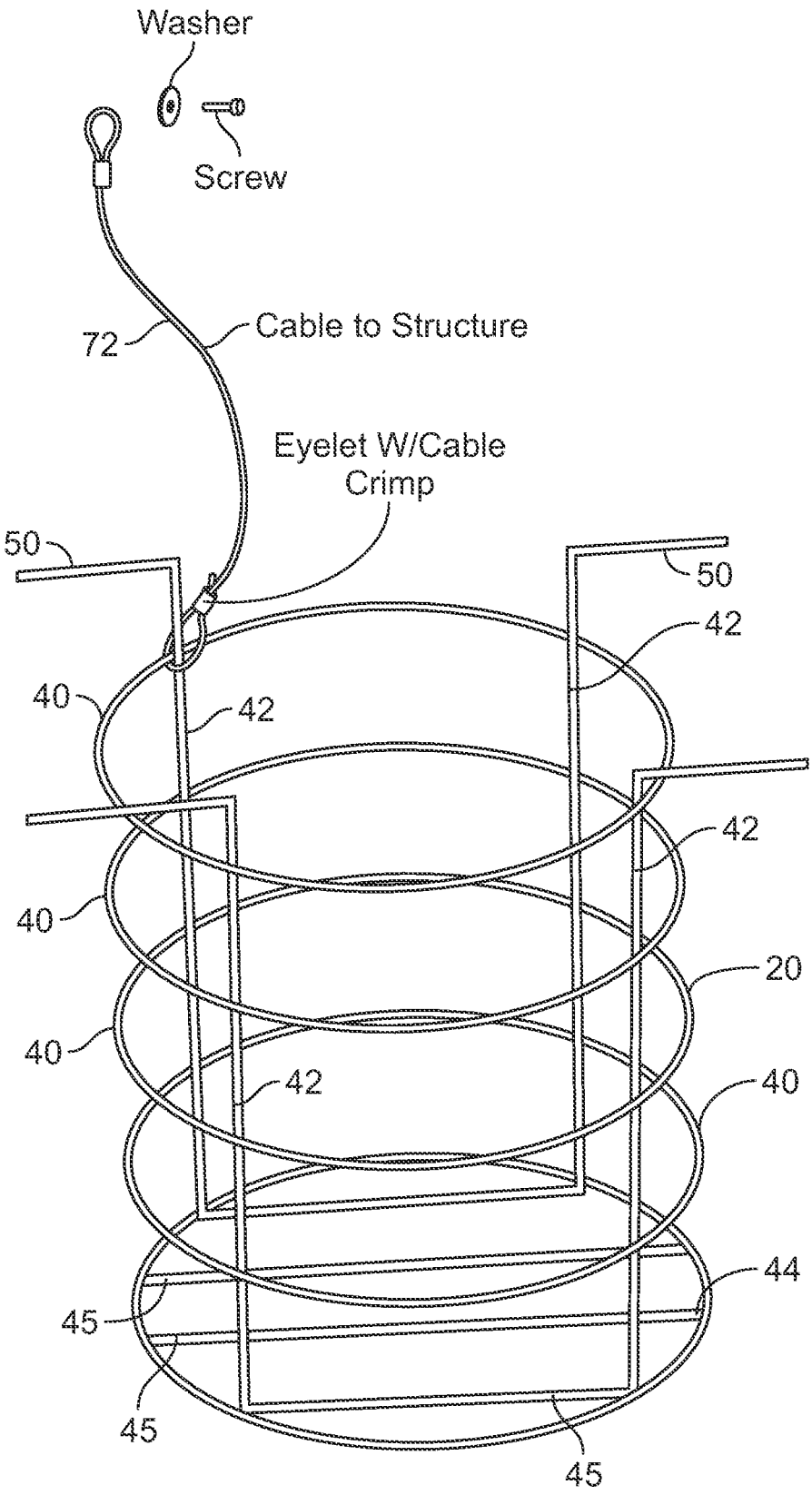
FIG. 6 illustrates another example of a cage device for a tubular skylight, with a safety cable that may be connected to a safety cage and connected to a structure or surface such as a roof or ceiling, in accordance with one embodiment of the present disclosure.
Figure 11:
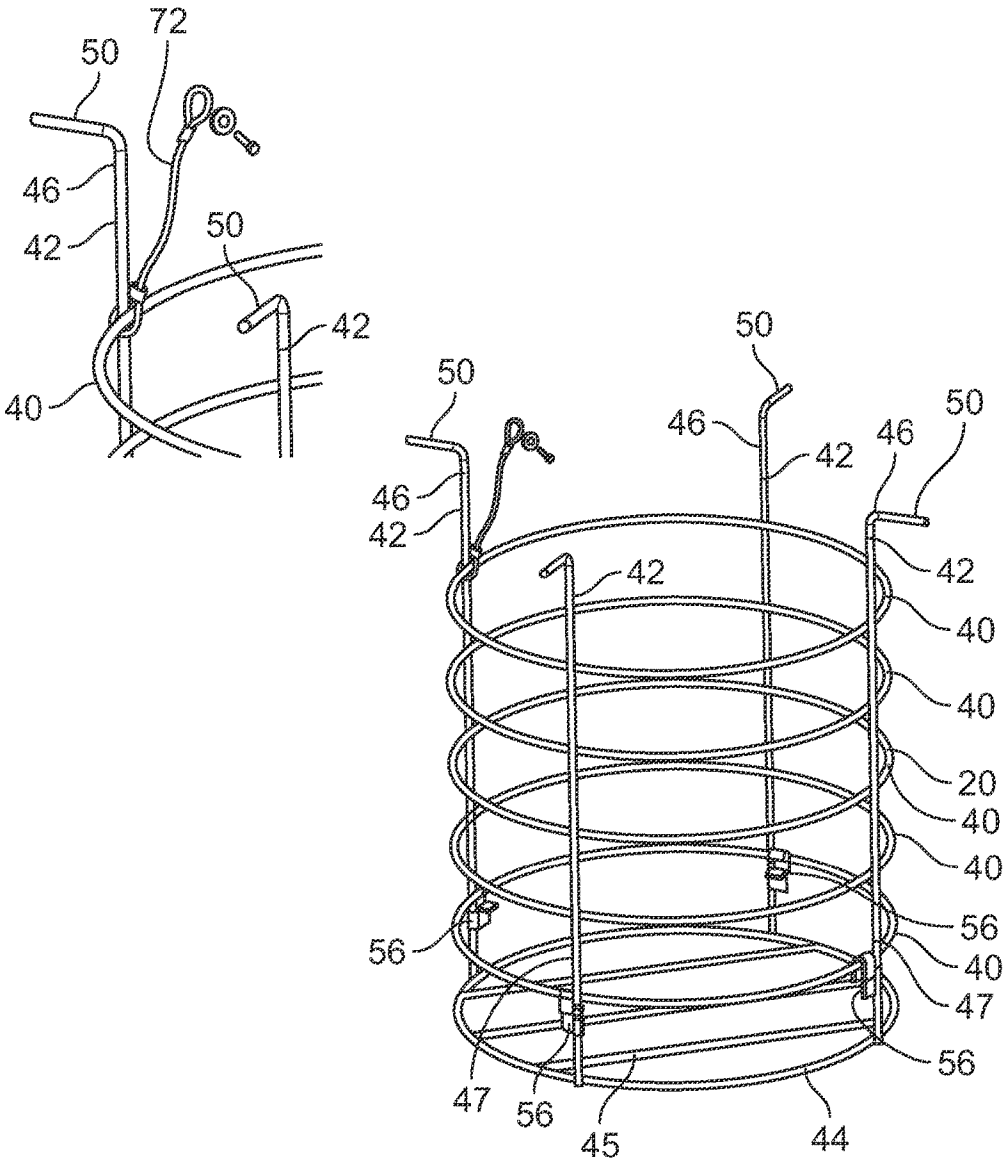
FIG. 11 illustrates another example of a cage device for a tubular skylight, with a removable bottom end cap and with a safety cable that may be connected to a safety cage and connected to a structure or surface such as a roof or ceiling, in accordance with one embodiment of the present disclosure.
Figure 12:
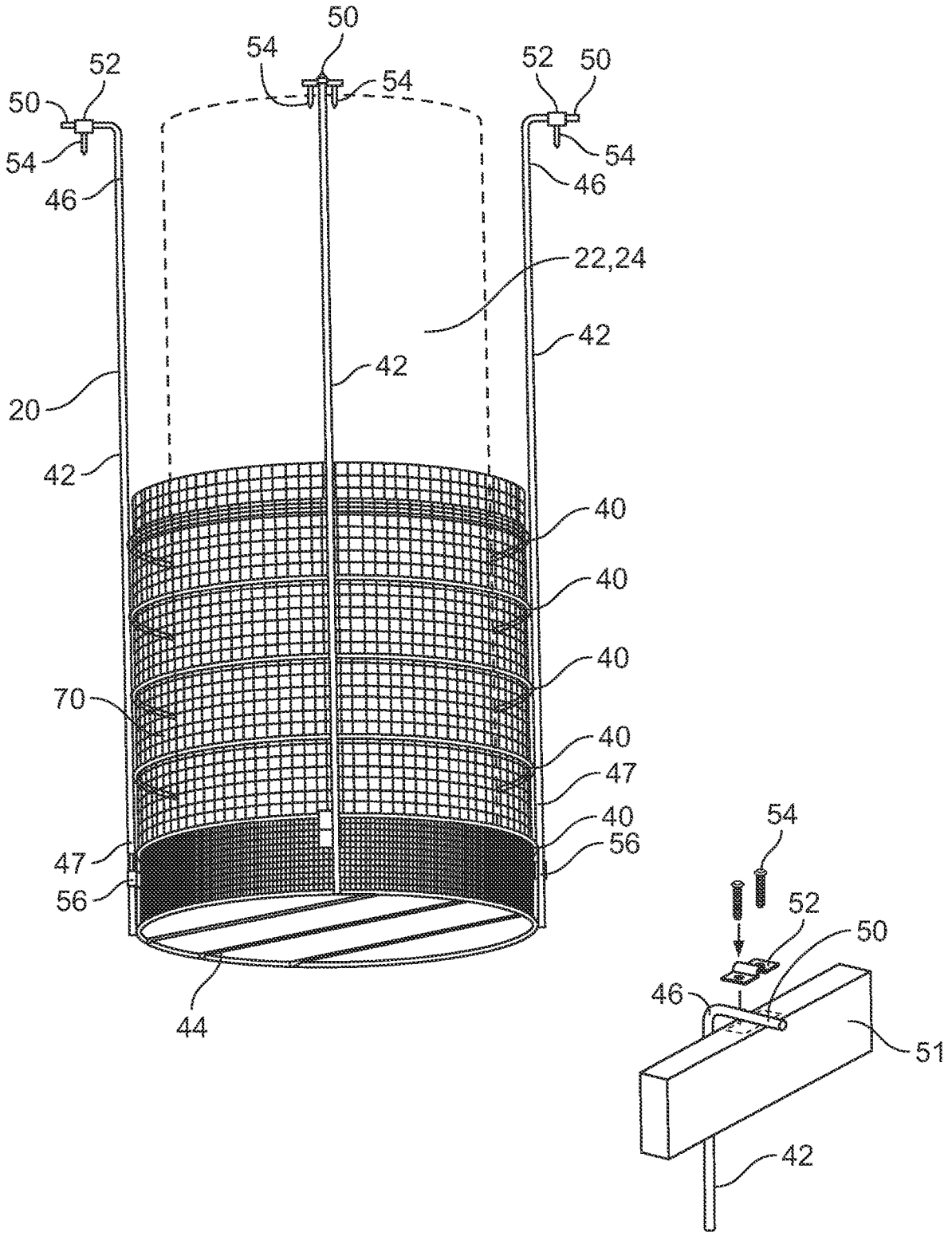
FIG. 12 illustrates another example of a cage device for a tubular skylight, with a portion of the cage device adapted to be connected with a support structure of the tubular skylight above the roof line such as in FIG. 10, the cage device also having a removable bottom portion and a mesh screen, in accordance with one embodiment of the present disclosure.

As shown in FIGS. 6 and 11, in one example, a safety tethering device 72 can be added and connected between a cage device 20 and the ceiling 32 or other surface or object in order to further reduce risk of detachment of the cage device 20 or of the enclosed skylight 22. In one example, the safety tethering device 72 may be a cable, wire, harness, or tether that on one end is connected with the cage device 20 (i.e., connected to one of the lateral members), and the other end of the safety tethering device 72 is secured to the ceiling 32 such as with a bolt/screw of sufficient size.

Figure 9A:
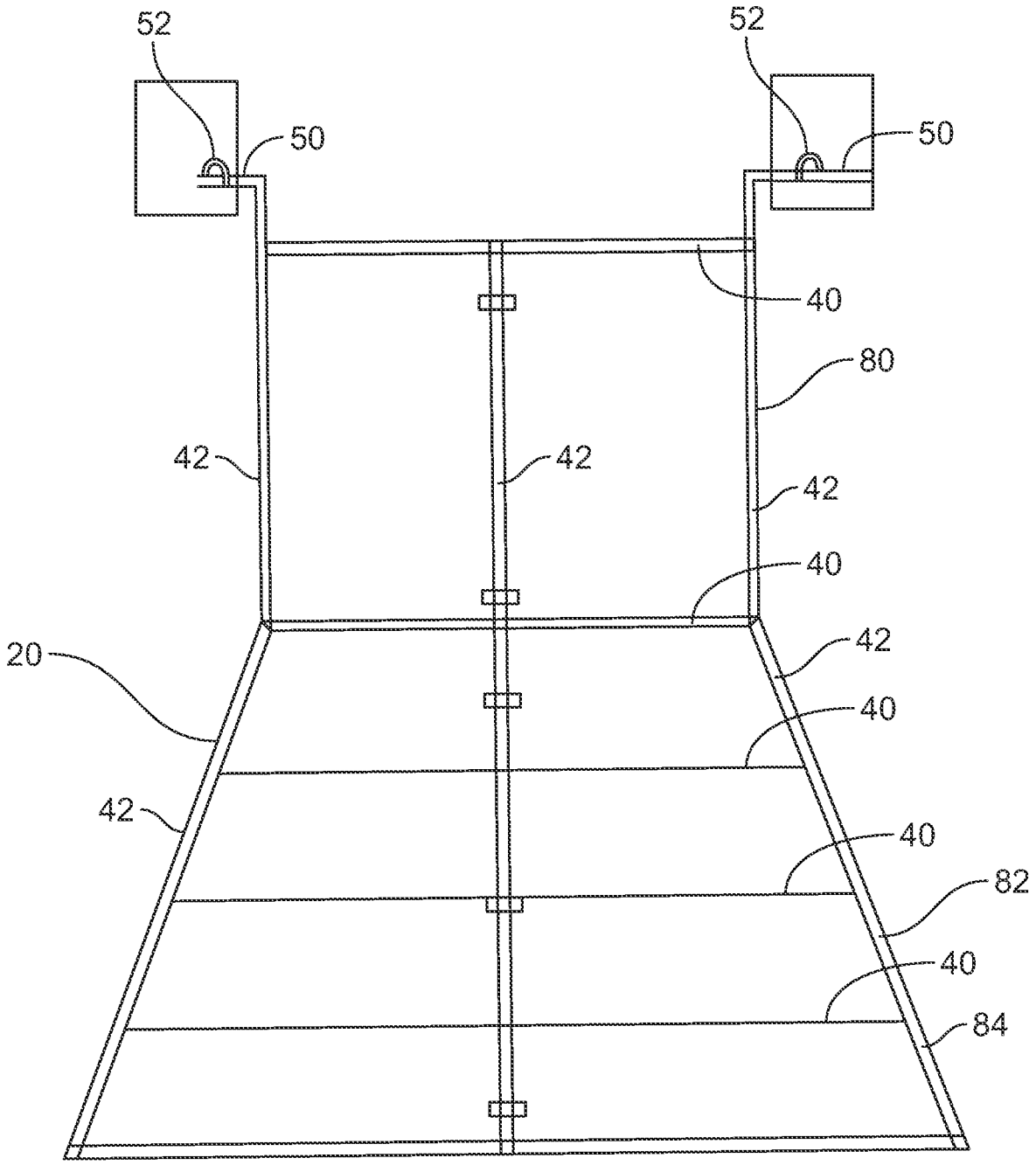
FIGS. 9A, 9C illustrate another example of a cage device for a tubular skylight, with a flared lower portion, in accordance with one embodiment of the present disclosure.
Figure 9B:
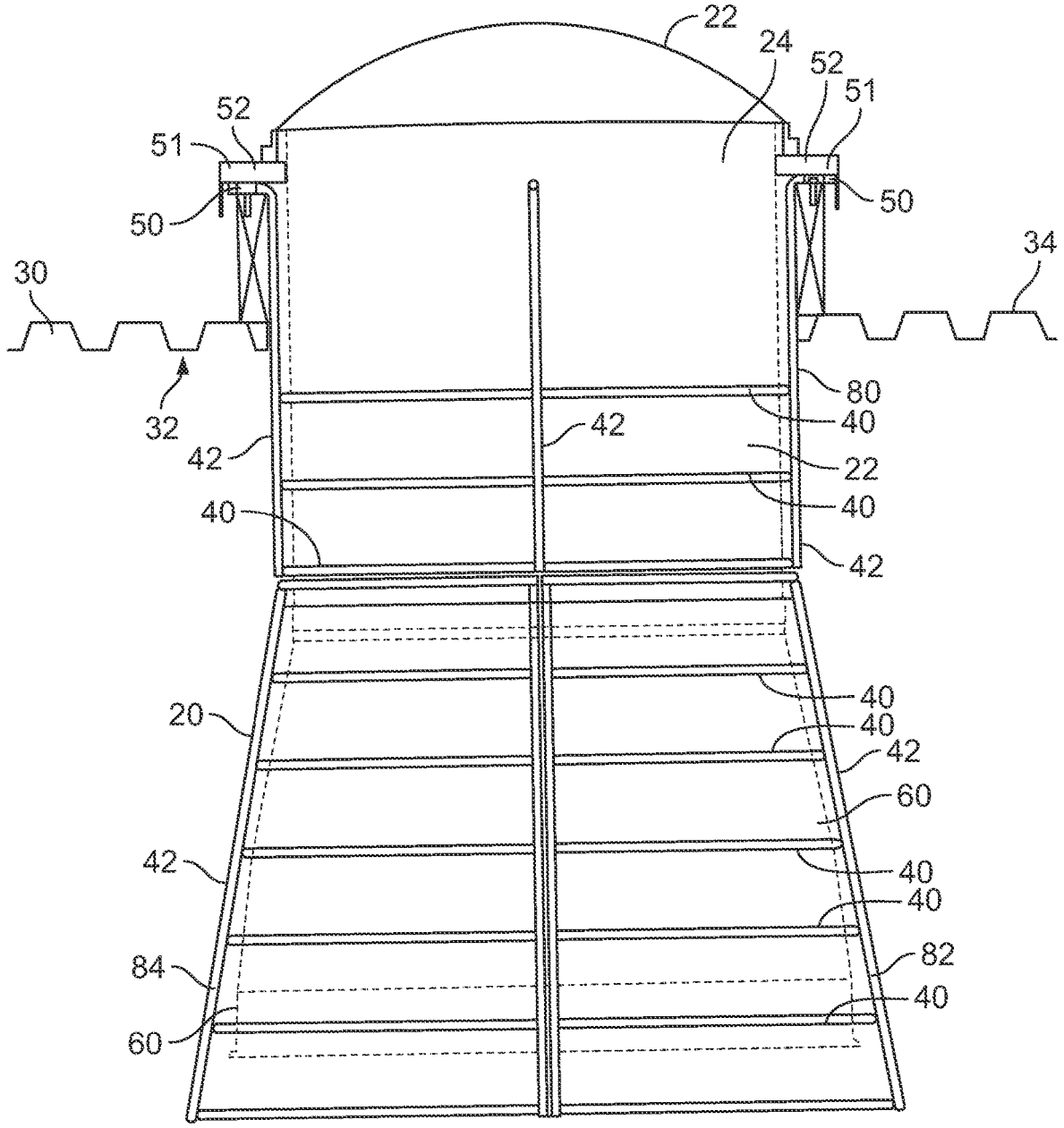
FIG. 9B illustrates the cage device of FIG. 9A, with a portion of the cage device connected with a support structure of a tubular skylight above the roof line, the cage device having a flared lower portion, in accordance with one embodiment of the present disclosure.
Figure 9C:
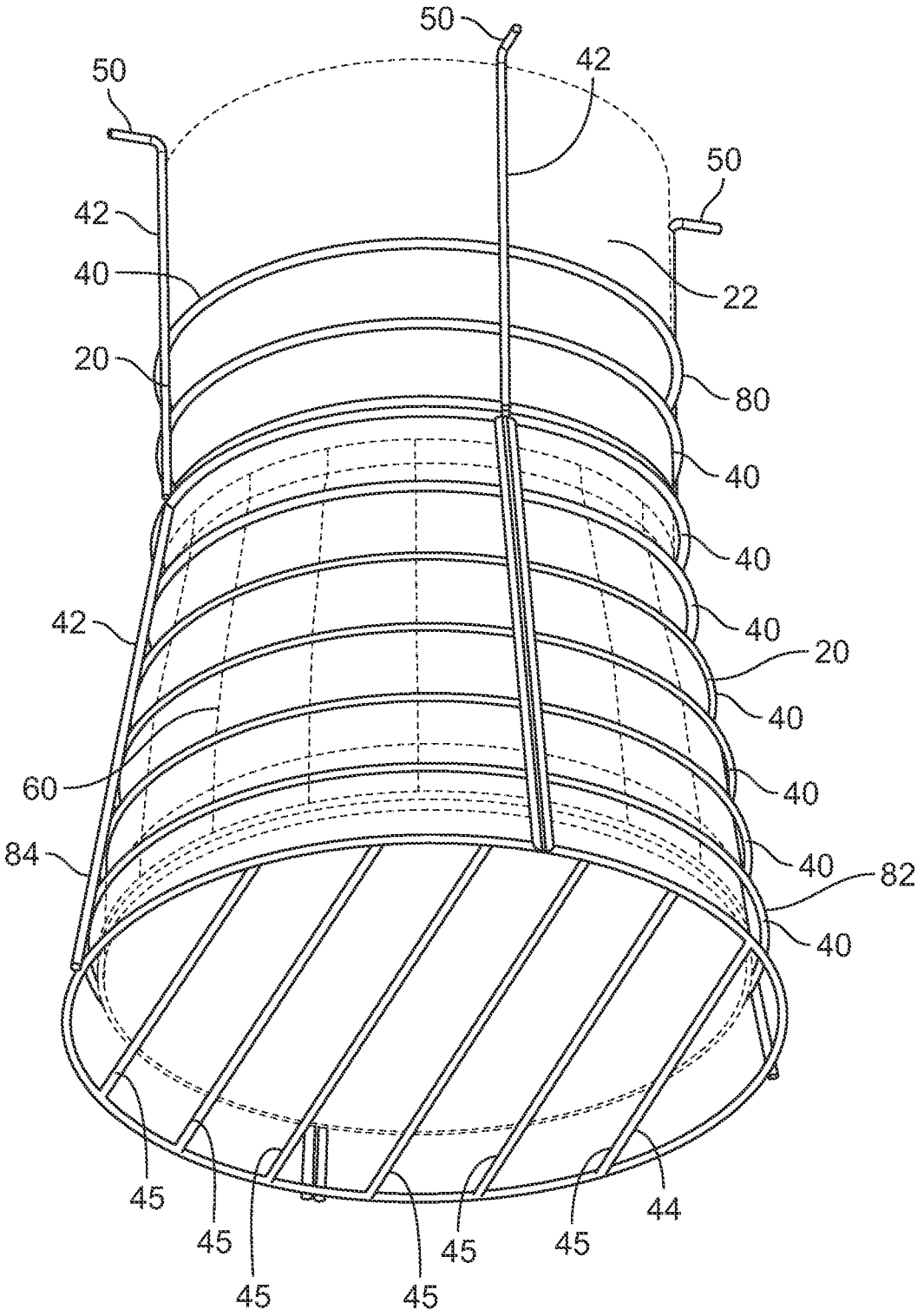
Figure 10:
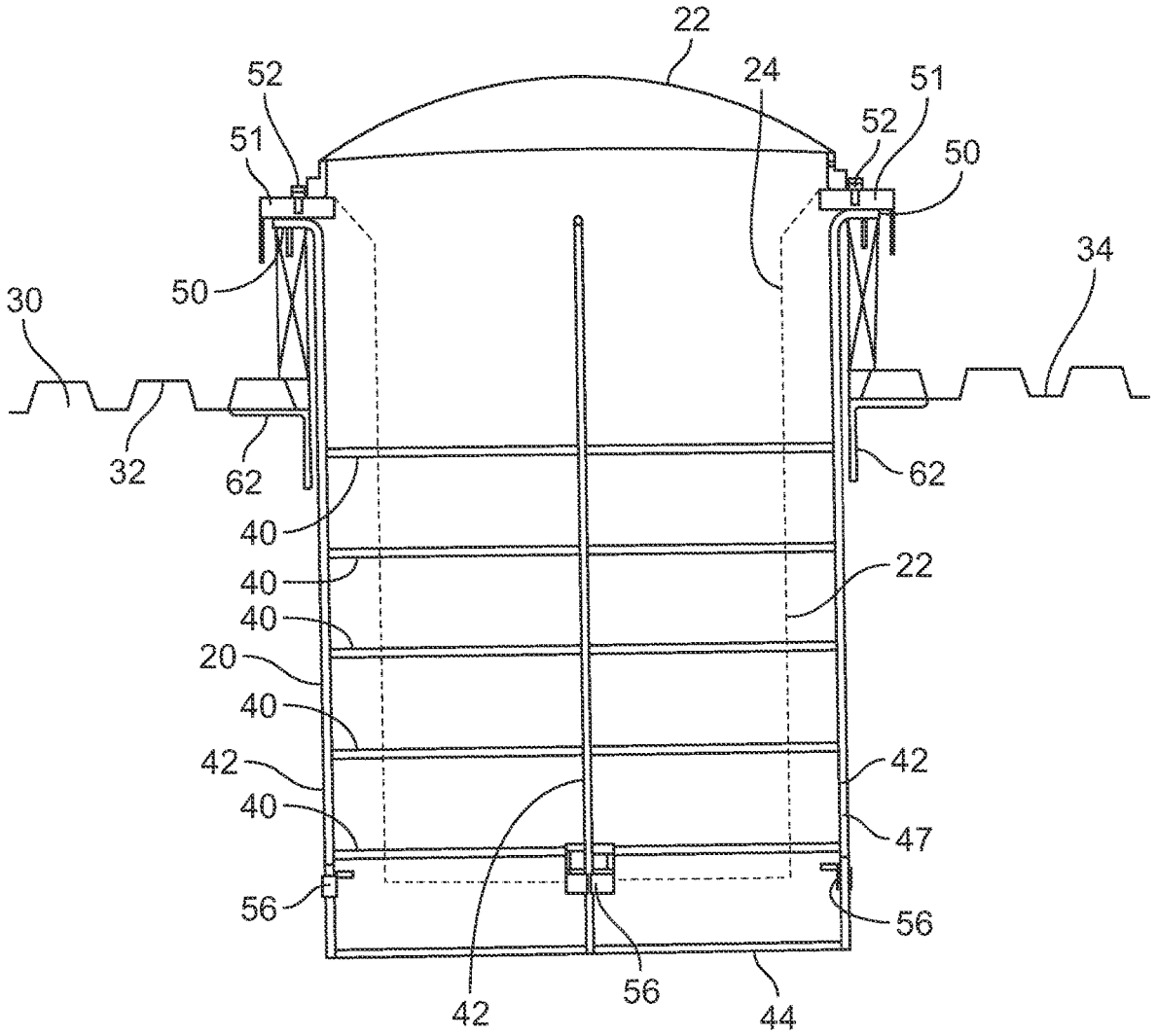
FIG. 10 illustrates another example of a cage device for a tubular skylight, with a portion of the cage device connected with a support structure of the tubular skylight above the roof line, the cage device also having a removable bottom portion, in accordance with one embodiment of the present disclosure.

Referring to FIGS. 9A-9C, a cage device 20 can be formed to be positioned about a skylight extension tube 24 that includes a two-part light amplifier 60. In this example, the cage device 20 can include an upper portion 80 and a lower portion 82 with an outwardly flaring portion 84. In this example, the lateral members 40 of the upper portion 80 of cage device 20 have a first perimeter that is larger than the perimeter (P) of the upper part of the extension tube 24; and the lateral members 40 of the lower portion 82 of cage device 20 have a perimeter of increasing size that are larger than the perimeters along various points of the lower portion of the extension tube 24 (such as around the lower amplifier portion 60 of the skylight 22). The vertical side members 42 may include one or more bends or angles, so that the side members 42 can be connected (i.e., via welds, or via integrated formation) with each of the lateral members 40. As shown in FIG. 9C, the cage device 20 can be provided with a removable bottom end base portion 44.

Cage devices 20 according to one or more aspects of the present disclosure can be installed around existing skylights 22 that have previously been installed in a building's ceiling 32; or in a new construction, a cage device 20 may be installed first into a ceiling 32, and then a skylight 22 can be positioned and connected with the ceiling 32. In this example, the installation of the cage device 20 may not require hydraulic lifts and can save cost and time on installation.

While the methods disclosed herein have been described and shown with reference to particular operations performed in a particular order, it will be understood that these operations may be combined, sub-divided, or re-ordered to form equivalent methods without departing from the teachings of the present disclosure. Accordingly, unless specifically indicated herein, the order and grouping of the operations is not a limitation of the present disclosure.

It should be appreciated that in the foregoing description of exemplary embodiments of the disclosure, various features of the disclosure are sometimes grouped together in a single embodiment, figure, or description thereof for the purpose of streamlining the disclosure and aiding in the understanding of one or more of the various aspects. This method of disclosure, however, is not to be interpreted as reflecting an intention that an embodiment requires more features than are expressly recited in each claim. Rather, inventive aspects lie in less than all features of a single foregoing disclosed embodiment, and each embodiment described herein may contain more than one inventive feature.

It will be understood by those skilled in the art that various changes in the form and details may be made from the embodiments shown and described without departing from the spirit and scope of the disclosure.

The invention claimed is:

1. A cage device capable of use to protect an extension tube of a tubular skylight in a ceiling of a building, the extension tube having a perimeter and a length extending downwardly from the ceiling, the cage device comprising:

a plurality of lateral members surrounding a portion of extension tube of the tubular skylight, the lateral members having a perimeter larger than the perimeter of the extension tube, the lateral members spaced apart along a portion of the extension tube;

a plurality of vertically oriented elongated side members positioned around the perimeter of the extension tube of the tubular skylight, each side member attached to a portion of one of said lateral members, each side member having a top end portion that includes a protrusion for secure attachment to the ceiling, each side member having a bottom end portion; and a removable end cap connected to the bottom end portions of the side members; wherein the removable end cap includes at least one horizontally orientated rod.

2. The cage device of claim 1, further comprising: a mesh screen positioned within the lateral members.

3. The cage device of claim 1, further comprising: a safety cable harness connected to one of said lateral members and secured to a ceiling.

4. The cage device of claim 1, wherein the side members are spaced equally apart around the perimeter of the extension tube.

5. The cage device of claim 1, wherein each of the side members is formed from a metal rod; wherein the lateral members are metal rods formed in a circular shape; and wherein each side member is attached to one of said lateral members using a welded connection.

6. The cage device of claim 1, wherein the lateral members and side members are formed using a mold.

7. A cage device capable of use to protect an extension tube of a tubular skylight in a ceiling of a building, the extension tube having a perimeter and a length extending downwardly from the ceiling, the cage device comprising:

a plurality of lateral members surrounding a portion of extension tube of the tubular skylight, the lateral members having a perimeter larger than the perimeter of the extension tube, the lateral members spaced apart along a portion of the extension tube;

a plurality of vertically oriented elongated side members positioned around the perimeter of the extension tube of the tubular skylight, each side member attached to a portion of one of said lateral members, each side member having a top end portion that includes a protrusion for secure attachment to the ceiling, each side member having a bottom end portion;

a removable end cap connected to the bottom end portions of the side members; and at least one bracket and at least one bolt, wherein each protrusion of each side member is securely connected to the ceiling by at least one bolt and at least one bracket.

8. The cage device of claim 7, wherein the side members are metal rods; wherein the lateral members are metal rods; and wherein each side member is attached to one of said lateral members using a welded connection.

9. A cage device capable of use to protect an extension tube of a tubular skylight in a ceiling of a building, the extension tube having a perimeter and a length extending downwardly from the ceiling, the cage device comprising:

a plurality of lateral members surrounding a portion of extension tube of the tubular skylight, the lateral members having a perimeter larger than the perimeter of the extension tube, the lateral members spaced apart along a portion of the extension tube;

a plurality of vertically oriented elongated side members positioned around the perimeter of the extension tube of the tubular skylight, each side member attached to a portion of one of said lateral members, each side member having a top end portion that includes a protrusion for secure attachment to the ceiling, each side member having a bottom end portion; and a plurality of bottom members connected horizontally across one of said lateral members;

a removable end cap connected to the bottom end portions of the side members;

wherein the removable end cap includes at least one horizontally orientated rod.

10. The cage device of claim 9, wherein each of the side members have a length longer than a length of a portion of the extension tube extending downwardly from the ceiling.

11. The cage device of claim 9, wherein the side members are spaced equally apart around the perimeter of the extension tube.

12. The cage device of claim 9, wherein the plurality of side members is formed from a set of four side members, spaced apart in 90-degree intervals from each adjacent side member.

13. The cage device of claim 9, wherein each of the side members is formed from a metal rod.

14. The cage device of claim 9, wherein each side member is attached to one of said lateral members using a welded connection.

15. The cage device of claim 9, wherein the lateral members are metal rods formed in a circular shape.

16. The cage device of claim 9, wherein the lateral members are spaced apart equally along a portion of the extension tube.

17. The cage device of claim 9, wherein each protrusion of each side member is securely connected to the roof.

18. The cage device of claim 9, further comprising: a safety tether cable connected to one of said lateral members and secured to the ceiling.

19. The cage device of claim 9, further comprising: a mesh screen positioned within the lateral members.

20. The cage device of claim 9, wherein the bottom members are selectively removable in order to provide access to the tubular skylight.

* * * * *